US005723040A

United States Patent [19]

Letzsch et al.

[11] Patent Number: 5,723,040

[45] Date of Patent: Mar. 3, 1998

[54] FLUID CATALYTIC CRACKING PROCESS AND APPARATUS

[75] Inventors: Warren S. Letzsch; Gerald Earl, both of Houston, Tex.

[73] Assignee: Stone & Webster Engineering Corporation, Boston, Mass.

[21] Appl. No.: 333,549

[22] Filed: Nov. 2, 1994

Related U.S. Application Data

[63] Continuation-in-part of Ser. No. 310,529, Sep. 22, 1994.

[51] Int. Cl.[6] ..... C10G 11/00; F27B 15/08

[52] U.S. Cl. ..... 208/113; 208/120; 208/151; 208/161; 422/144

[58] Field of Search ..... 208/113, 120, 208/151, 161; 422/144

[56] References Cited

U.S. PATENT DOCUMENTS

| | | | |
|---|---|---|---|
| 2,906,695 | 9/1959 | Boston | 208/127 |
| 4,404,095 | 9/1983 | Haddad et al. | 208/161 |
| 4,424,116 | 1/1984 | Hettinger, Jr. | 208/120 |
| 4,450,241 | 5/1984 | Hettinger, Jr. et al. | 502/34 |
| 4,464,250 | 8/1984 | Myers et al. | 208/120 |
| 4,605,636 | 8/1986 | Walters et al. | 502/39 |
| 4,698,212 | 10/1987 | Walters et al. | 422/144 |
| 4,753,907 | 6/1988 | Zandona et al. | 502/20 |
| 4,764,268 | 8/1988 | Lane | 208/113 |
| 4,814,067 | 3/1989 | Gartside et al. | 208/127 |
| 4,822,761 | 4/1989 | Walters et al. | 502/38 |
| 4,946,656 | 8/1990 | Ross et al. | 422/144 |
| 4,978,440 | 12/1990 | Krambeck et al. | 208/113 |
| 5,043,058 | 8/1991 | Forgac et al. | 208/48 Q |
| 5,073,249 | 12/1991 | Owen | 208/48 Q |
| 5,112,576 | 5/1992 | Kruse | 422/144 |
| 5,141,625 | 8/1992 | Lomas | 208/113 |
| 5,158,669 | 10/1992 | Centinkaya | 208/113 |
| 5,194,227 | 3/1993 | Miller et al. | 422/140 |
| 5,259,855 | 11/1993 | Ross, Jr. et al. | 208/161 |
| 5,308,473 | 5/1994 | Markham et al. | 208/113 |

FOREIGN PATENT DOCUMENTS

| | | | |
|---|---|---|---|
| 1387919 | 3/1975 | United Kingdom | B01J 8/28 |

OTHER PUBLICATIONS

Hatch & Matar, "From Hydrocarbons to Petrochemicals," pp. 15–37, 1981, (No Month).

*Primary Examiner*—Walter D. Griffin

*Attorney, Agent, or Firm*—Hedman, Gibson & Costigan, P.C.

[57] ABSTRACT

The present invention provides a method for improving the contacting of feedstock and regenerated catalytic particulates in certain fluid catalytic cracking processes and apparatus.

11 Claims, 4 Drawing Sheets

FLUID CATALYTIC CRACKING PROCESS AND APPARATUS

CROSS REFERENCE TO RELATED APPLICATIONS

The present application is a continuation-in-part of Letzsch et al., U.S. patent application Ser. No. 08/310,529 entitled, "SHORT RESIDENCE TIME CRACKING APPARATUS AND PROCESS", filed on Sep. 22, 1994, attorney docket no. 696–236.

FIELD OF THE INVENTION

The present invention relates to catalytic cracking of hydrocarbonaceous feedstocks. More particularly, the present invention relates to an improved fluid catalytic cracking process and apparatus. Most particularly, the present invention relates to a method for improving the contacting of feedstock and regenerated catalytic particulates in certain fluid catalytic cracking processes and apparati.

BACKGROUND OF THE PRESENT INVENTION

The FCC process has in recent times become the major system by which crude oil is converted into gasoline and other hydrocarbon products. Basically, the FCC process includes contacting a hot particulate catalyst with a hydrocarbon feedstock in a riser reactor to crack the hydrocarbon feedstock, thereby producing cracked products and spent coked catalyst. The coked catalyst is separated from the cracked products, stripped and then regenerated by burning the coke from the coked catalyst in a regenerator. The catalyst is heated during the regeneration by the burning of the coke. The hot catalyst is then recycled to the riser reactor for additional cracking.

A variety of process configurations have been developed to accomplish the fluid catalytic cracking of hydrocarbonaceous feedstocks. Exemplary of these FCC processes are Haddad et al., U.S. Pat. No. 4,404,095 (Mobil), Lane, U.S. Pat. No. 4,764,268 (Texaco), Quinn et al., U.S. Pat. No. 5,087,427 (Amoco), Forgac et al., U.S. Pat. No. 5,043,058 (Amoco), Schwartz et al., U.S. Pat. No. 5,089,235 (Amoco) and Gartside et al., U.S. Pat. No. 4,814,067 (SWEC).

In similar fashion, Ashland Oil, Inc. has also developed an FCC process. This process is exemplified in Hettinger, Jr. et al., U.S. Pat. No. 4,450,241; Walters et al., U.S. Pat. No. 4,822,761; and Zandona et al., U.S. Pat. No. 4,753,907. In the Ashland process, the spent catalyst is transported by gravity from a stripping vessel to an upper regenerator zone of a two zone regenerator. The catalyst from the upper regenerator zone is then fed via gravity to a lower regenerator zone to complete regeneration of the spent catalyst. The regenerated catalyst from the lower regenerator zone is then fed via a standpipe to a lower portion of a riser reactor. The catalyst is then lifted up the riser reactor with the addition of a lift gas to form a dilute phase of catalyst. About half-way up the riser, the dilute phase of catalyst is then contacted with a hydrocarbon feed stream, and cracking occurs in the upper half of the riser reactor only in order to reduce residence time. The spent catalyst and cracked products are then discharged into a disengaging vessel for separation of the cracked products from the spent catalyst and stripping of the spent catalyst.

While the Ashland process has met with some degree of success, the process suffers from the drawback of needing to employ a relatively long riser reactor due to pressure balance considerations. Consequently, in order to reduce the contact time between the catalyst and feedstock, the catalyst is fed to the bottom of the riser reactor, and is lifted up the riser to contact the feed in the upper portion of the riser. Thus, at the point of contact with the feedstock, the catalyst is in the dilute phase.

It would therefore represent a notable advance in the state of the art if the foregoing drawbacks could be overcome. To this end the present invention provides a method of relocating the feed in an Ashland type process which overcomes these drawbacks.

SUMMARY OF THE PRESENT INVENTION

It is therefore an object of the present invention to provide an improved method of catalytically cracking hydrocarbon feedstocks.

It is also an object of the present invention to provide a method for improving an existing FCC system.

It is a further object of the present invention to provide a method wherein the location of the entry point of the feedstock is changed.

It is another object of the present invention to provide an improved method of contacting the regenerated catalyst and the feedstock.

It is still another object of the present invention to significantly reduce the amount of steam employed as a lift gas in an FCC process.

To this end, the present invention provides an apparatus for providing an improved catalytic cracking apparatus and method.

The present invention also provides a method for modifying an existing FCC system to improve the contacting of the feedstock and regenerated catalyst.

DETAILED DESCRIPTION OF THE PRESENT INVENTION AND DESCRIPTION OF THE PREFERRED EMBODIMENTS

The present invention is directed to modifying an existing FCC process configuration to improve the location of the feedstock entry point into the riser reactor such that the feedstock contacts the regenerated catalyst in a dense phase as opposed to a dilute phase without increasing the contact time between the catalyst and feedstock.

Figure 1:
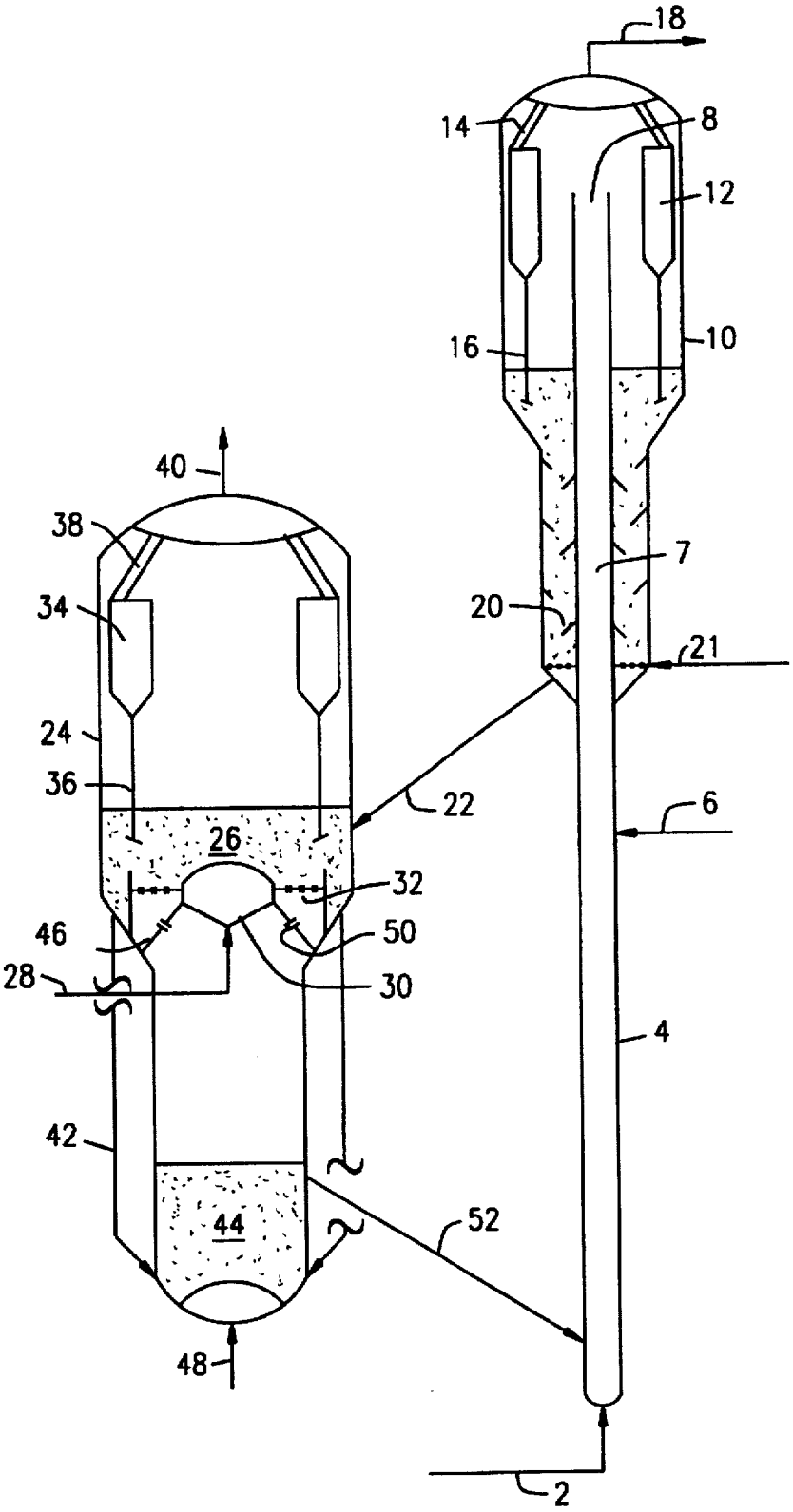
FIG. 1 is a planar view of a process configuration of the prior art.

The prior art FCC configuration of which the present invention is an improvement is shown in FIG. 1. In FIG. 1, a lift gas, such as steam or light hydrocarbons, is injected into the bottom of a riser reactor 4 via a line 2. The lift gas lifts the regenerated catalyst entering the bottom of riser reactor 4 through standpipe 52 in a dilute phase up the riser reactor 4. At a point about half way up the total length of the riser reactor, the feedstock is injected into riser 4 via a feed line 6 wherein the feedstock contacts the catalyst in the dilute phase.

The cracking reaction proceeds in an upper portion of the riser reactor 7 and discharges into a stripper vessel 10 through outlet 8. A rough cut separator (not shown) may be provided at outlet 8. In stripper vessel 10 the spent catalyst and cracked product are separated in cyclones 12, with the cracked product exiting the cyclones 12 through lines 14 and exiting the stripper vessel 10 through line 18 for downstream processing.

The separated spent catalyst is directed via diplegs 16 into a dense phase bed 20 of the stripper vessel 10. Steam for stripping is admitted via a line 21. The stripped spent catalyst is then removed from the stripper vessel 10 via a standpipe 22 and directed to a dense fluidized catalyst bed 26 of an upper stage of a two-stage regenerator vessel 24.

In the dense fluidized catalyst bed 26, catalyst is contacted with a mixture of flue gases comprising $CO_2$, CO and steam from the dense fluidized bed of 44 of the lower stage of the two stage regenerator vessel 24. Oxygen containing gas is also introduced into dense fluidized catalyst bed 26 via a line 28, chamber 30 and distributing arms 32. The flue gas product of the oxygen regeneration in bed 26 rich in CO is passed through cyclones 34 for removal of catalyst fines before passing to a CO boiler via lines 38 and 40 to convert carbon monoxide to carbon dioxide $CO_2$ which may in turn be recycled to the regenerator sections for use as described below. The separated catalyst fines are returned to the dense bed 26 via diplegs 36.

The partially regenerated catalyst of dense bed 26 is transported via lines 42 to the lower dense bed 44. Optionally, a catalyst cooler (not shown) may be provided in lines 42 as is known to those skilled in the art. Air and/or carbon dioxide rich gas is admitted to lower dense fluidized catalyst bed 44 via a line 48 to convert the residual carbon to carbon monoxide. The resulting flue gas of the $CO_2$+C reaction passes through grids 46 and openings 50 and into upper fluidized catalyst bed 26. The regenerated catalyst is then removed from regenerator vessel 24 via a stand pipe 52 and directed to the lower portion of the riser reactor 4.

As will be appreciated by those of ordinary skill in the art, in order to accommodate the pressure balances within this prior art FCC process configuration, it is necessary to employ a relatively long riser reactor in order to enable the catalyst to easily circulate within the system. Consequently, to prevent overcracking of the feedstock due to the long catalyst contact times inherent with a long riser reactor, the feed entry point into the riser reactor must be located in an upper portion of the riser reactor, i.e., at about halfway up the riser reactor, while the catalyst entry point is at the bottom of the riser reactor. This further requires the use of a large amount of lift gas to lift the catalyst up to the feed entry point, which in turn results in a dilute phase of catalyst contacting the feedstock.

The present invention overcomes these drawbacks by modifying the existing configuration such that the feed entry point can be located at the bottom of the riser reactor thereby contacting a dense phase of catalyst and improving cracking. To this end, the present invention provides for severing the long riser reactor and placing a rough cut separation device at the point of truncation to reduce the time of contact between catalyst and feedstock. The cracked product is then redirected up the remaining portion of the riser reactor, and the catalyst is directed to a stripper riser and lift to the stripping section of the stripping vessel.

Figure 2:
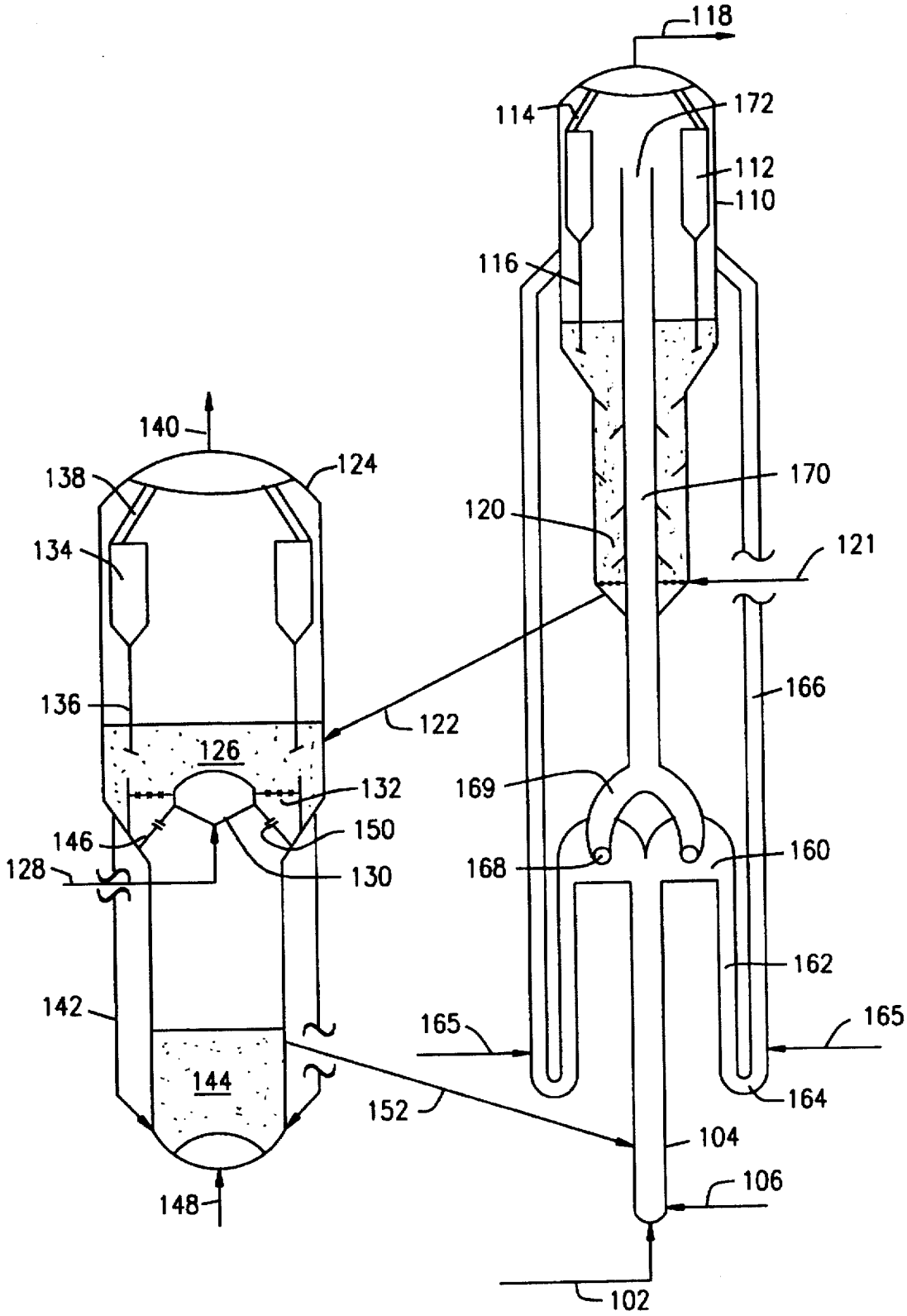
FIG. 2 is a planar view of an embodiment of the present invention.

In modifying an existing Ashland type FCC riser reactor to an improved FCC system, the riser reactor 4 of FIG. 1 is cut or bisected to the desired length. Referring to FIG. 2, in this manner the lower portion constitutes a shortened riser reactor 104 and the upper portion constitutes a stripper vessel inlet means or riser product conduit 170.

The hydrocarbonaceous feedstock is relocated to enter the shortened riser reactor 104 at the lower end thereof via a line 106. Any conventional FCC feed may be employed in the practice of the present invention. Usually the feed to an FCC unit comprises gas oils, vacuum gas oils, topped crudes etc. Feedstocks useful in the practice of the present invention also include the heavy feeds, such as residual oils, tar sands, shale oil and asphaltic fractions.

The regenerated catalyst, and any fresh make-up catalyst required, is also fed into the lower end of the shortened riser reactor 104 via a line 152. Any of the known FCC catalysts can be employed in accordance with the present invention. Preferably, the catalyst is one of the many commercially available zeolite based catalysts, i.e. crystalline aluminosilicates. Especially preferred are zeolites having relatively large pores such as those in the faujasite family, i.e., type Y, US-Y, chemically treated type Y, hydrochemically treated type Y, direct synthesis of high silica/alumina (Si/A1>6) faujasite, all with rare earth and/or ammonium exchanged. Active matrices for these catalysts are also preferred. Optionally, the catalyst may contain one or more of known promoters, such as CO oxidation promoters including but not limited to platinum components, metal passivation promoters, etc. These are well known to those skilled in the art and are described in the patent literature. See, e.g., Bertus et al., U.S. Pat. No. 4,238,637 and McKay et al., U.S. Pat. No. 4,283,274. Catalysts employing medium pore size zeolites (about 5–6 Å) but smaller than the pores contained in the faujasite structure, can also be used either by themselves or with the large pore zeolites, e.g., faujasites, to produce light olefins ($C_2$–$C_5$) for intermediate or finished petrochemical and/or refinery process.

The feedstock and catalyst proceed up the shortened riser reactor 104. Optionally, but not necessary to the present invention, a lift gas entering via a line 102 may also be employed if desired. At the top of the shortened riser reactor 104 and external to the stripper vessel 110 is located a first separation means 160 which provides a quick gross separation of the cracked products from the spent catalyst. It is contemplated herein that after the gross separation in the first separation means 160, some catalyst particles and catalyst fines will remain entrained with the cracked products.

The first separation means can be any of those known to those skilled in the art, including but not limited to a cyclone separator, an inverted can separator, e.g. Pfeiffer et al., U.S. Pat. No. 4,756,886, a baffle separator, e.g., Haddad et al., U.S. Pat. No. 4,404,095, a rams horn separator as disclosed in Ross et al., U.S. Pat. No. 5,259,855, a global separator as disclosed in Barnes, U.S. Pat No. 4,891,129 and/or a U-shaped separator as disclosed in Gartside et al., U.S. Pat. No. 4,433,984.

Figure 3:
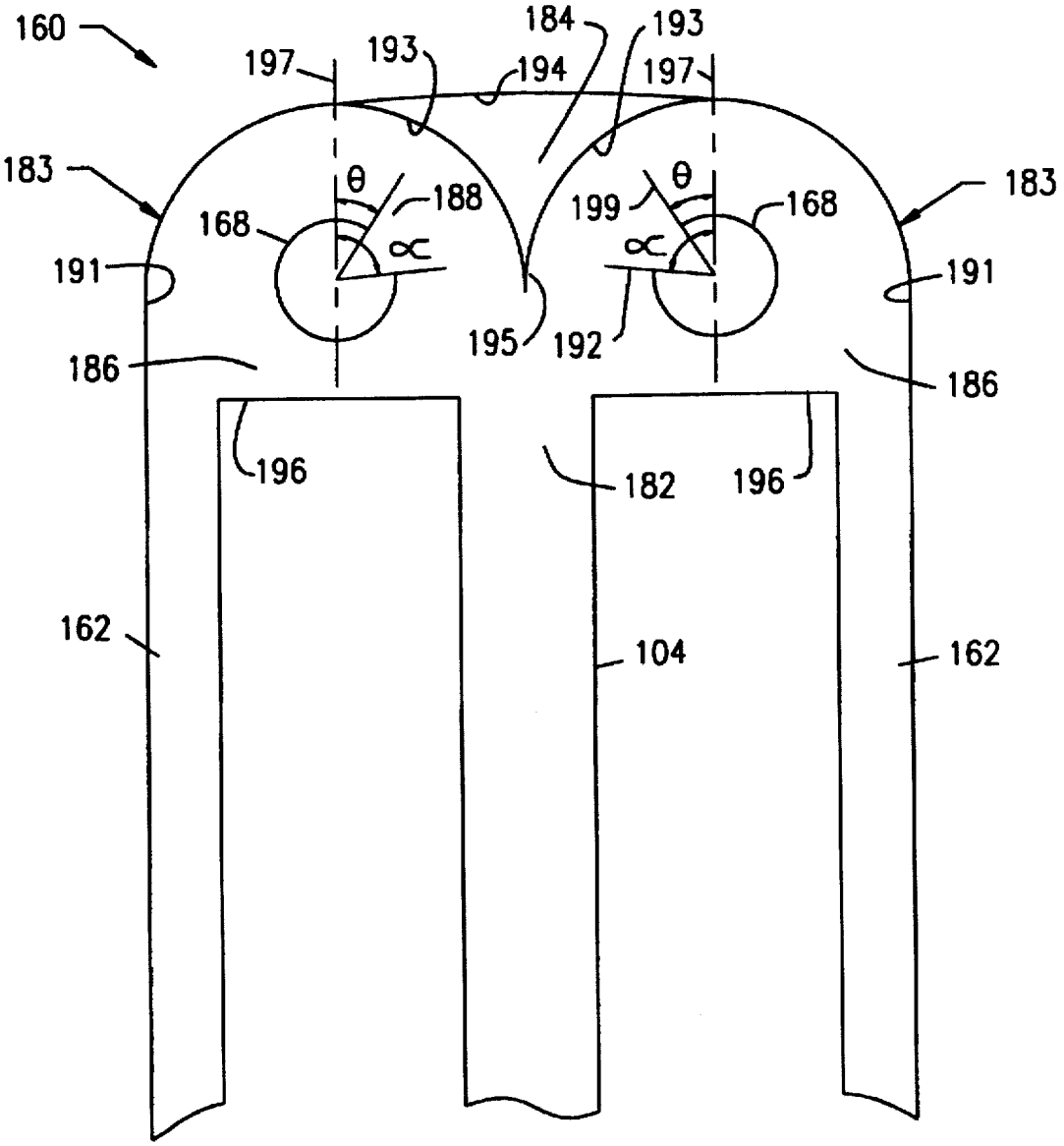
FIG. 3 is a cross sectional view of a separation apparatus useful in the practice of the present invention.

Especially preferred is a rams horn type separator. Referring to FIG. 3, the separator 160 is comprised of a separator housing 183, deflection means 184, two parallel gas outlets 168, two downwardly flowing solids outlets or diplegs 162 and a centrally located cracked gas-solids inlet 182.

The centrally located cracked gas-solids inlet 182 is located in the base of the separator 160, directly above the terminal end of the shortened riser reactor 104. The deflection means 184 is wedge-shaped with the side walls 193 having a concave shape. The base 194 of the deflection means 184 is attached to the inner surface 191 of the separator housing 183. The point 195 of the deflection means 184 is preferably located directly above the center of the centrally located cracked gas-solids inlet 182. The deflection means divides the separator 160 into two distinct semi-circular separating areas 186. It is also contemplated that the rams horn separator may have between one (a half rams horn) and four or more separating areas. Typically, there will be two semi-circular separating areas 186. The semi-circular separating areas 186, are defined by the concave side walls 193 of deflection means 184 and the concave walls 191 of the separator housing 183.

Each semi-circular separating area 186, contains a gas outlet 168. Each gas outlet 168 is horizontally disposed and runs parallel to the base 196 of the separator 160 and parallel to the inner concave surface 191 of the separator housing 183. Each gas outlet 168 also contains a horizontally disposed gas opening 188 which can be located at any position around the gas outlet 168. In a preferred embodiment, the horizontally disposed gas opening 188 extends the length of the gas outlet 168, and is positioned to face upwardly and inwardly, with respect of the shortened riser reactor 104, toward deflection means 184. The lower edge 192 of the gas opening 188 is at an angle a to the vertical center line 197 of the gas outlet tube 168 and the upper edge 199 is at an angle $\Theta$ to the vertical center line 197. The angle $\alpha$ can range from 30° to 135° with the preferred range being 30° to 90° and the angle $\Theta$ can range from −30° to 75° with the preferred range being 0° to 30°.

In one embodiment of the separator, the gas opening 188 is oriented toward the riser reactor 104 and directed upward. The angle $\alpha$ is about 90° to the vertical center line 197 and the angle $\Theta$ is about 30° to the vertical center line 197.

It is also contemplated that the horizontally disposed gas opening 188 extends the length of the gas outlet 168 and is positioned to face outwardly, with respect to the riser reactor 104, toward the concave surface 191 of the separator.

Returning to FIG. 2, the gas outlets 168 remove the cracked product, generally entrained with a small portion catalyst fines and particulates, i.e., from 0–10% by weight, more preferably 0–5% and most preferably 0.1–2%, from the first separating means 160. The gas outlets 168 in turn direct the cracked product via conduits 169 into an inlet means 170 to a disengaging or stripper vessel 110. The inlet means 170 merely comprises the upper portion of the severed riser reactor.

The stripper vessel inlet means or riser product conduit 170 may enter the stripper or disengaging vessel 110 in a variety of positions. The inlet means or riser product conduit 170 can enter the vessel 110 from the side or preferably through the center of the bottom of the vessel.

In one embodiment, the inlet means 170 enters the vessel 110 centrally through the bottom and may be close coupled to a secondary cyclone separator 112 located in the upper dilute phase of the vessel. In the secondary cyclone 112, any entrained catalyst particulates or catalyst fines are separated from the cracked products. The cracked products are then removed via lines 114 and 118 from the vessel 110 and directed to a downstream processing facility, as is known to those skilled in the art.

Alternatively, the inlet means 170 can discharge the cracked product vapor through outlet 172 directly into the upper dilute phase of the vessel 110. In this type of embodiment, a second separation means (not shown) at the downstream end of the stripper vessel inlet means 172 may optionally be employed. The cracked product vapor is then drawn into a secondary cyclone 112 for further separation of entrained catalyst fines and particulates. The second separation means may be a tee separator, inertial separator, vented riser, axial cyclone, or rams horn type separator.

The entrained catalyst fines and particulates separated from the cracked product vapor in the secondary cyclone 112 and optionally the second separating means are then directed into the dense bed of catalyst in the bottom of the vessel 110 via a dipleg 116 as is well known to those skilled in the art.

In an alternative embodiment, it is contemplated by the present invention to include one or more quench means to quench the cracked product vapor. The quench means can be located in the first separation means outlet conduits 169, in the riser product conduit or stripper vessel inlet means 170, in the second separation means outlets (if any), at the entrance to the secondary cyclones 112, or in the case of an open secondary cyclone in the dilute phase of the vessel, at a location above the outlet 172 of the inlet means 170 or at a position in the dilute phase directly above the dense bed of catalyst.

It is further contemplated by the present invention that the shortened riser reactor 104 can be sized such that the average total kinetic residence time of the hydrocarbons in the FCC process, i.e., from the time of contact of the feedstock with the catalyst through quenching of the cracked product, is less than 1 second, more preferably less than 0.6 seconds. Typically the average total kinetic residence time will be on the order of from about 0.05 seconds to about 0.6 seconds.

The quench can comprise a variety of quench media known to those skilled in the art, including hydrocarbon liquids, and water or steam. Desirably, the quench is a hydrocarbon liquid which has previously been cracked or otherwise processed to remove the most reactive species. Thus, particularly suitable as quench media are kerosene, light coker gas oil, coker still distillates, hydrotreated distillate, fresh unprocessed virgin feedstocks such as virgin gas oil, heavy virgin naphtha and light virgin naphtha, light catalytic cycle oil, heavy catalytic cycle oil, heavy catalytic naphtha and mixtures of any of the foregoing.

The first separating means 160 also contains at least one downwardly flowing solids outlet 162. The downwardly flowing solids outlets or diplegs 162 are directed in parallel to the riser reactor for a length sufficient to provide a sealing of the diplegs 162. At the end of each of the diplegs, the diplegs 162 preferably flare out at an angle and direct the spent catalyst into the bottom of one or more stripper risers 166. In this regard, the diplegs 162 can combine into a single stripper riser 166 or each can be connected to its own respective stripper riser 166 as shown in FIG. 2.

A mechanical valve may also be employed at the bottom of diplegs 162 to control the catalyst flow but is not necessary. The valves may comprise any mechanical valve known to those skilled in the art including but not limited to slide valves or trickle valves. The valves act to control the flow of the catalyst out of the diplegs 162. Alternatively, it is contemplated that a J bend or J valve 164 may be used to provide a seal.

The diplegs 162 direct the coked catalyst particulates into a stripper riser 166 wherein a stripping media is admitted via lines 165 to lift the catalyst particles and strip volatile hydrocarbons from the coked catalyst particulates in a dilute phase. The stripping media may comprise steam or other stripping media such as light hydrocarbons. Preferably, the stripping media employed in the stripper riser comprises at least a portion of the lift gas which was employed to lift the catalyst up the riser reactor in the previously existing Ashland configuration, supplied via a line 2 (FIG. 1) or 102. The stripper riser 166 is typically a straight vertical transfer line conduit which runs parallel to the riser reactor and enters the stripper vessel 110 in the dilute phase. It is further contemplated that a third separating means may be employed at the downstream end of the stripper riser. In the third separating means (not shown), volatile hydrocarbons and steam are separated from the stripped spent catalyst. The volatile hydrocarbons and steam are then directed to the dilute phase of the stripper vessel, while the stripped spent catalyst are directed into the lower dense phase bed of the stripper vessel 110.

The stripper vessel 110 is a vessel that is designed to receive the effluents from the stripper inlet means 170 and the stripper riser 166, and contain an upper dilute phase and a lower dense bed of catalyst. The stripping or disengaging vessel 110 is conventionally a relatively large vessel, usually several orders of magnitude larger in volume than the riser reactor 104, which serves to collect spent catalyst in the lower portion of the vessel, i.e. the dense phase bed, and the vapors in the upper portion of the vessel, i.e. dilute phase. The spent catalyst is withdrawn from the bottom of the vessel 110, usually through a stripper zone 120 containing baffles and/or other devices for providing intimate contacting of the steam and catalyst and removed from the vessel. Stripping steam is added in one or more places via a line 121 and usually at the bottom of the vessel 110 through a ring to displace remaining easily strippable hydrocarbons from the spent catalyst, so that these strippable hydrocarbons can be recovered and not burned in the regenerator 124.

The stripped spent catalyst is then removed from the stripper vessel 110 via a standpipe 122 and directed to a dense fluidized catalyst bed 126 of an upper stage of a two-stage regenerator vessel 124.

In the dense fluidized catalyst bed 126, catalyst is contacted with a mixture of flue gases comprising $CO_2$, CO and steam from the dense fluidized bed of 144 of the lower stage of the two stage regenerator vessel 124. Oxygen containing gas is also introduced into dense fluidized catalyst bed 126 via a line 128, chamber 130 and distributing arms 132. The flue gas product of the oxygen regeneration in bed 126 rich in CO is passed through cyclones 134 for removal of catalyst fines before passing to a CO boiler via lines 138 and 140 to convert carbon monoxide to carbon dioxide $CO_2$ which may in turn be recycled to the regenerator sections for use as described above. The separated catalyst fines are returned to the dense bed 126 via diplegs 136.

The partially regenerated catalyst of dense bed 126 is transported via lines 142 to the lower dense bed 144. Optionally, a catalyst cooler (not shown) may be provided in lines 142 as is known to those skilled in the art. Air and/or carbon dioxide rich gas is admitted to lower dense fluidized catalyst bed 144 via a line 148 to convert the residual carbon to carbon monoxide. The resulting flue gas of the $CO_2$+C reaction passes through grids 146 and openings 150 and into upper fluidized catalyst bed 126. The regenerated catalyst is then removed from regenerator vessel 124 via a stand pipe 152 and directed to the lower portion of the riser reactor 104.

Figure 4:
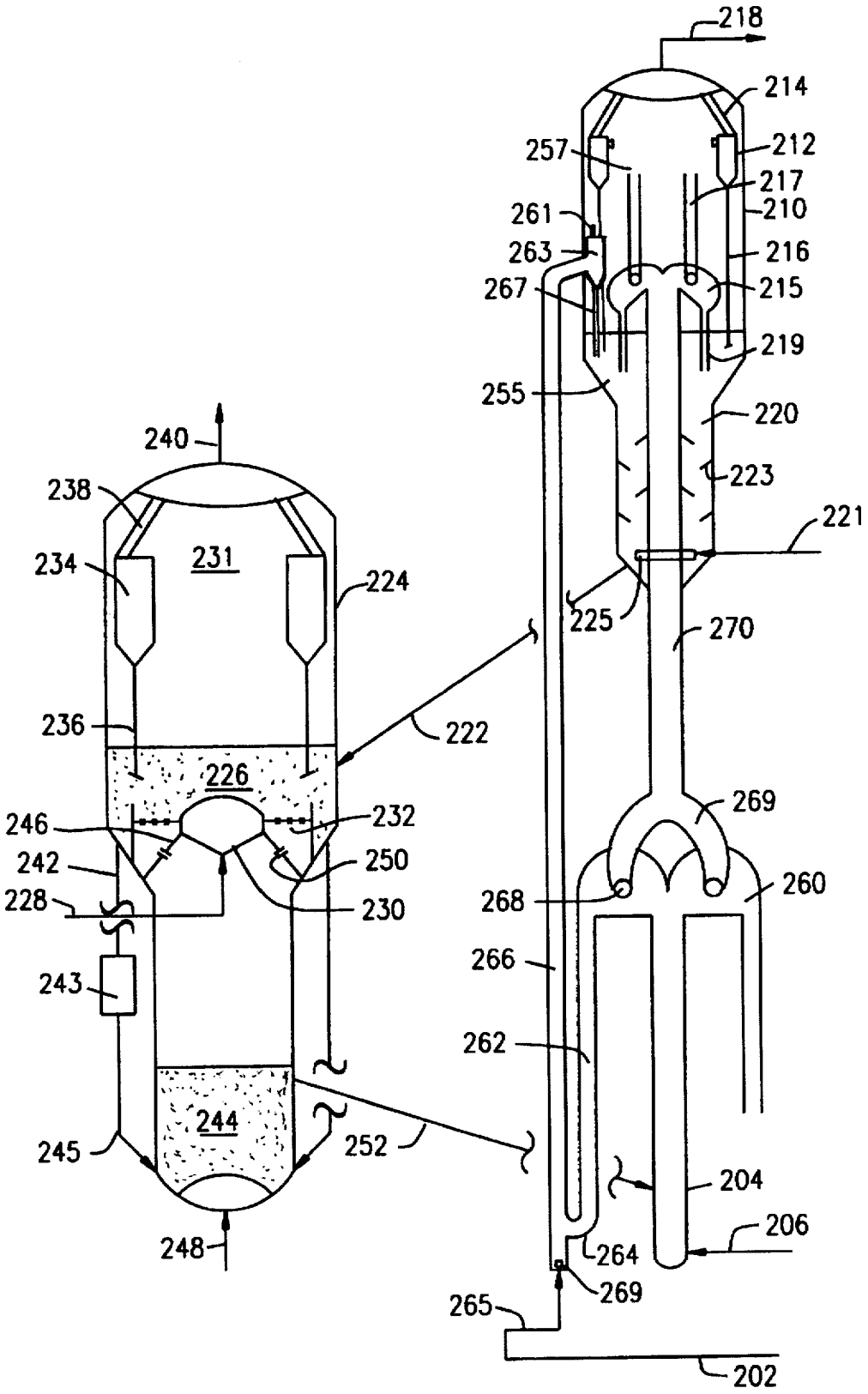
FIG. 4 is a planar view of another embodiment of the present invention.

In another preferred embodiment, referring to FIG. 4, a hydrocarbon feedstock via a line 206 and cracking catalyst via a line 252 are contacted in a shortened riser reactor 204. As the feedstock and catalyst are contacted in riser reactor 204, cracking occurs forming a mixture of cracked product and spent catalyst. The mixture is separated in a rams horn separator 260 into a stream of spent catalyst and a stream of cracked product entrained with a small portion of spent catalyst.

The cracked product stream is withdrawn through separator outlets 268 and directed via conduits 269 to the riser product conduit 270. At the terminal end of the riser product conduit 270, a major portion of the entrained spent catalyst is separated from the cracked product in a second rams horn separator 215. The cracked product is removed from the second rams horn separator 215 in conduits 217 and discharged into the upper dilute phase 257 of stripper vessel 210.

The spent catalyst separated from the second rams horn separator 215 is directed via diplegs 219 into a lower dense phase bed 255 of stripper vessel 210.

The spent catalyst separated from the first rams horn separator 260 is withdrawn from separator 260 via diplegs 262, which is sealed by J valve 264. The spent catalyst then enters a stripper riser 266 and is lifted up the stripper riser 266 with stripping gas supplied via lines 202 and 265 and stripping ring 269. In stripper riser, volatile hydrocarbons are stripped from the spent catalyst in a dilute phase to form a stream of stripped spent catalyst, stripping media and volatile hydrocarbons.

The stripper riser 266 terminates in a cyclone 263 located in the dilute phase 257 of stripper vessel 210. The cyclone 263 separates the stripping media and volatile hydrocarbons from the stripped spent catalyst. The stripping media and volatile hydrocarbons are discharged via outlet 261 into the dilute phase 257 of the stripper vessel 210, while the stripped spent catalyst is directed via dipleg 267 into the dense phase bed 255 of stripper vessel 210.

In the upper dilute phase 257 of the stripper vessel 210, the cracked product, stripping media and volatile hydrocarbons are drawn into secondary cyclones 212 for removal of any remaining catalyst fines. The cracked product, stripping media and volatile hydrocarbons are withdrawn from secondary cyclones 212 through conduits 214 and withdrawn from the stripper vessel via a line 218 for downstream processing. The catalyst fines are withdrawn from secondary cyclones 212 via diplegs 216 and directed into the dense phase bed 255 of stripper vessel 210.

The spent catalyst in the dense phase bed 255 proceed into stripper zone 220 wherein the catalyst particles are contacted with steam via a line 221 and distributing ring 225 over baffles 223.

The stripped spent catalyst is then removed from the stripper vessel 210 via a standpipe 222 and directed to a dense fluidized catalyst bed 226 of an upper stage of a two-stage regenerator vessel 224.

In the dense fluidized catalyst bed 226, the catalyst is contacted with a mixture of flue gases comprising $CO_2$, CO and steam from the dense fluidized bed of 244 of the lower stage of the two stage regenerator vessel 224. Oxygen containing gas is also introduced into dense fluidized catalyst bed 226 via a line 228, chamber 230 and distributing arms 232. The flue gas product of the oxygen regeneration in bed 226 rich in CO is passed into dilute phase zone 231 and through cyclones 234 for removal of catalyst fines before passing to a CO boiler via lines 238 and 240 to convert carbon monoxide to carbon dioxide $CO_2$ which may in turn be recycled to the regenerator sections for use as described above. The separated catalyst fines are returned to the dense bed 126 via diplegs 136.

The partially regenerated catalyst of dense bed 226 is transported via lines 242 through a catalyst cooler 243 and fed into the lower dense bed 244 via a line 245. Air and/or carbon dioxide rich gas is admitted to lower dense fluidized catalyst bed 244 via a line 248 to convert the residual carbon to carbon monoxide. The resulting flue gas of the $CO_2$+C reaction passes through grids 246 and openings 250 and into upper fluidized catalyst bed 226. The regenerated catalyst is then removed from the lower dense phase bed 244 of regenerator vessel 224 via a stand pipe 252 and directed to the shortened riser reactor 204.

Many variations of the present invention will suggest themselves to those skilled in the art in light of the above-detailed description. For example, a quench injector may be added at any point downstream of the first separation means and preferably upstream of the secondary cyclone. Further, the stripper vessel inlet means and the secondary cyclone may or may not be close coupled. Other types of gross cut separators known to those skilled in the art may be employed in place of the rams horn separator. Hot catalyst from a regenerator, e.g., the first and/or second stages of a two stage regenerator, or a single stage regenerator, may be recycled directly to the spent catalyst riser(s) or stripper vessel to improve stripping by raising the temperature. All such obvious modifications are within the full intended scope of the appended claims.

All of the above-referenced patents, patent applications and publications are hereby incorporated by reference.

We claim:

1. A method of improving an FCC process wherein cracking catalyst is fed into a lower portion of a riser reactor and is lifted up the riser reactor with a lift gas to an upper portion of the riser reactor wherein the cracking catalyst in a dilute phase contacts a hydrocarbon feedstock and cracking occurs in the upper portion of the riser reactor, the terminal end of the riser reactor discharging into a stripper vessel; the improvement comprising bisecting said riser reactor to form a shortened riser reactor in a lower portion thereof and a stripper vessel inlet means in an upper portion thereof;

connecting said shortened riser reactor at the point of bisection to a first separating means having a vapor outlet and a solids outlet;

connecting said vapor outlet to said stripper vessel inlet means for discharge into said stripper vessel;

connecting said solids outlet to a stripper riser comprising a stripper gas inlet means, a vertical transfer line conduit and a stripper riser outlet means;

connecting said stripper riser outlet means to said stripper vessel; and relocating the hydrocarbon feedstock feedline to enter the shortened riser reactor at the lower end thereof.

2. A method as defined in claim 1 wherein said first separating means comprises a rams horn separator.

3. A method as defined in claim 1 further comprising connecting said riser reactor lift gas to said stripper gas inlet means.

4. A method as defined in claim 1 wherein said stripper vessel comprises an upper dilute phase and a lower dense phase and said stripper riser outlet means is connected to discharge into the upper dilute phase of said stripper vessel.

5. A method as defined in claim 4 further comprising connecting said stripper riser outlet means to a second separating means located in the upper dilute phase of said stripper vessel.

6. A method as defined in claim 5 wherein said second separating means comprises a cyclone separator.

7. A method as defined in claim 1 wherein said riser reactor is bisected to a length whereby said shortened riser reactor provides a contact time between catalyst and feedstock of less than 1.0 seconds.

8. A method as defined in claim 7 wherein said shortened riser reactor provides a contact time of less than 0.6 seconds.

9. A method as defined in claim 1 further comprising providing a quench means located either in the first separating means vapor outlet, the stripper vessel inlet means, the stripper vessel or a combination of any of the foregoing.

10. A method as defined in claim 9 wherein said quench means is located in said stripper vessel inlet means.

11. A process for the fluid catalytic cracking of hydrocarbonaceous feedstock comprising the steps of:

(a) cracking a hydrocarbonaceous feedstock in the presence of a dense phase of cracking catalyst in a riser reactor to form a stream of cracked product and spent catalyst;

(b) separating a major portion of spent catalyst from said cracked product to form a stream of spent catalyst and a stream of cracked product entrained with spent catalyst particulates;

(c) further separating the entrained spent catalyst particulates from said cracked product in a stripper vessel;

(d) stripping volatile hydrocarbons from the spent catalyst from step (b) with a stripping media in a dilute phase stripper riser to provide a stream of stripped spent catalyst, stripping media and volatile hydrocarbons;

(e) separating the volatile hydrocarbons and stripping media from the stripped spent catalyst in said stripper vessel;

(f) stripping the separated entrained spent catalyst from step (c) and further stripping the stripped spent catalyst from step (e) by contacting the spent catalyst with steam in said stripper vessel;

(g) withdrawing the cracked product, stripping media and volatile hydrocarbons from said vessel;

(h) partially regenerating the stripped spent catalyst in the upper zone of a two zone regenerator;

(i) passing the partially regenerated catalyst downwardly from the upper zone to a lower zone of said two zone regenerator;

(j) completing regeneration of the partially regenerated catalyst in said lower regeneration zone;

(k) recycling the regenerated catalyst from said lower regeneration zone to said riser reactor.

* * * * *